US011284696B2

(12) United States Patent
Shinoda et al.

(10) Patent No.: US 11,284,696 B2
(45) Date of Patent: Mar. 29, 2022

(54) THIN FILM AFFIXING DEVICE

(71) Applicant: Panasonic Intellectual Property Management Co., Ltd., Osaka (JP)

(72) Inventors: Masayo Shinoda, Tokyo (JP); Hiroshi Kanemaru, Osaka (JP); Kazuma Tsujita, Hyogo (JP); Takao Kajima, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 479 days.

(21) Appl. No.: 16/293,843

(22) Filed: Mar. 6, 2019

(65) Prior Publication Data

US 2019/0200726 A1 Jul. 4, 2019

Related U.S. Application Data

(63) Continuation of application No. PCT/JP2017/028514, filed on Aug. 7, 2017.

(30) Foreign Application Priority Data

Sep. 27, 2016 (JP) ..... JP2016-187864

(51) Int. Cl.
*A45D 40/00* (2006.01)
*A45D 42/00* (2006.01)
(Continued)

(52) U.S. Cl.
CPC ..... *A45D 40/00* (2013.01); *A45D 42/00* (2013.01); *A45D 44/002* (2013.01); *A45D 44/22* (2013.01); *A45D 2200/1027* (2013.01)

(58) Field of Classification Search
CPC ..... A45D 44/22; A45D 44/00; A45D 44/002; A45D 40/00; A45D 42/00; A45D 2200/1027
(Continued)

(56) References Cited

U.S. PATENT DOCUMENTS

2014/0047708 A1 2/2014 Chae
2015/0265030 A1 9/2015 Kusukame et al.
2019/0200732 A1* 7/2019 Shinoda ..... A45D 44/22

FOREIGN PATENT DOCUMENTS

JP 62-180000 8/1987
JP 2014-140978 8/2014
(Continued)

OTHER PUBLICATIONS

International Search Report of PCT application No. PCT/JP2017/028514 dated Oct. 3, 2017.
(Continued)

*Primary Examiner* — Jennifer C Chiang
(74) *Attorney, Agent, or Firm* — Greenblum & Bernstein, P.L.C.

(57) ABSTRACT

A thin film affixing device used to affix a thin film to an adherend surface, such as the face of a user, is provided. The thin film affixing device is configured to include a main portion having a first surface and a second surface, where the first surface has a temporary adherend portion that allows the thin film to be temporarily attached thereto, a holding member that holds the main portion so that the first side is viewable from the second side through the main portion and the temporary adherend portion is capable of pressing against the adherend surface, and a transparent hydrophilic layer formed on the first surface of the main portion so as to serve as the temporary adherend portion.

14 Claims, 13 Drawing Sheets

(51) Int. Cl.
*A45D 44/00* (2006.01)
*A45D 44/22* (2006.01)

(58) Field of Classification Search
USPC ..... 604/347
See application file for complete search history.

(56) References Cited

FOREIGN PATENT DOCUMENTS

| | | |
|---|---|---|
| JP | 2015-043836 | 3/2015 |
| JP | 2015-193604 | 11/2015 |

OTHER PUBLICATIONS

The Extended European Search Report dated Sep. 12, 2019 for the related European Patent Application No. 17855444.0.

* cited by examiner 25
24
5

37
29
31
30
38

24
5
25

50
30
29
5
24
25
31

29
30
25
24
5
31

31
25
5
24

α
5
24
25
42
41

24
5
25
41

24
5
25
31
42
41

THIN FILM AFFIXING DEVICE

BACKGROUND

1. Technical Field

The present disclosure relates to a thin film affixing device and, in particular, to a thin film affixing device used when a thin film, such as a cosmetic sheet, is affixed onto an adherend surface (the skin in the case of a cosmetic sheet).

2. Description of the Related Art

Techniques for making discolored areas of the skin, such as patches in the cheek, unnoticeable have been developed (refer to, for example, Japanese Unexamined Patent Application Publication No. 2015-43836). According to the technique described in Japanese Unexamined Patent Application Publication No. 2015-43836, a discolored area of the skin is first identified by using a captured image of the skin. Thereafter, a cosmetic sheet (a thin film) which can be affixed to the skin and on which the color of a non-discolored area is printed is generated so as to have a size equal to or larger than the discolored area. By attaching the cosmetic sheet generated in this manner to the skin, the discolored area of the skin can become unnoticeable.

In addition, Japanese Unexamined Patent Application Publication No. 62-180000 describes a thin film affixing device (a transfer tool) for affixing a thin film to a surface (a transfer surface). In such a thin film affixing device, a thin film affixed to and held by an adhesive layer formed by the thin film affixing device is pressed against an adherend surface.

SUMMARY

According to the thin film affixing device described in Japanese Unexamined Patent Application Publication No. 62-180000, it is difficult to perform an affixing operation while checking the positional relationship between the thin film and the discolored area in the direction in which the thin film is pressed against the adherend surface (hereinafter the direction is referred to as a "pressing direction"). Consequently, the thin film may not be affixed to the adherend surface with high accuracy.

In one general aspect, the techniques disclosed here feature a thin film affixing device for affixing a thin film to an adherend surface. The thin film affixing device includes a transparent main portion having a first surface and a second surface, where the first surface has a temporary adherend portion that allows the thin film to be temporarily attached thereto, a holding member that holds the main portion so that the first side is viewable from the second side through the main portion and the temporary adherend portion is capable of pressing against the adherend surface, and a transparent hydrophilic layer formed on the first surface of the main portion so as to serve as the temporary adherend portion.

According to the present disclosure, a thin film can be affixed to an adherend surface with high accuracy.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Embodiments of the present disclosure are described in detail below with reference to the accompanying drawings.

1. First Embodiment

A first embodiment of the present disclosure is described below with reference to FIGS. 1 to 6.

1.1 Thin Film Affixing Device

Figure 1:
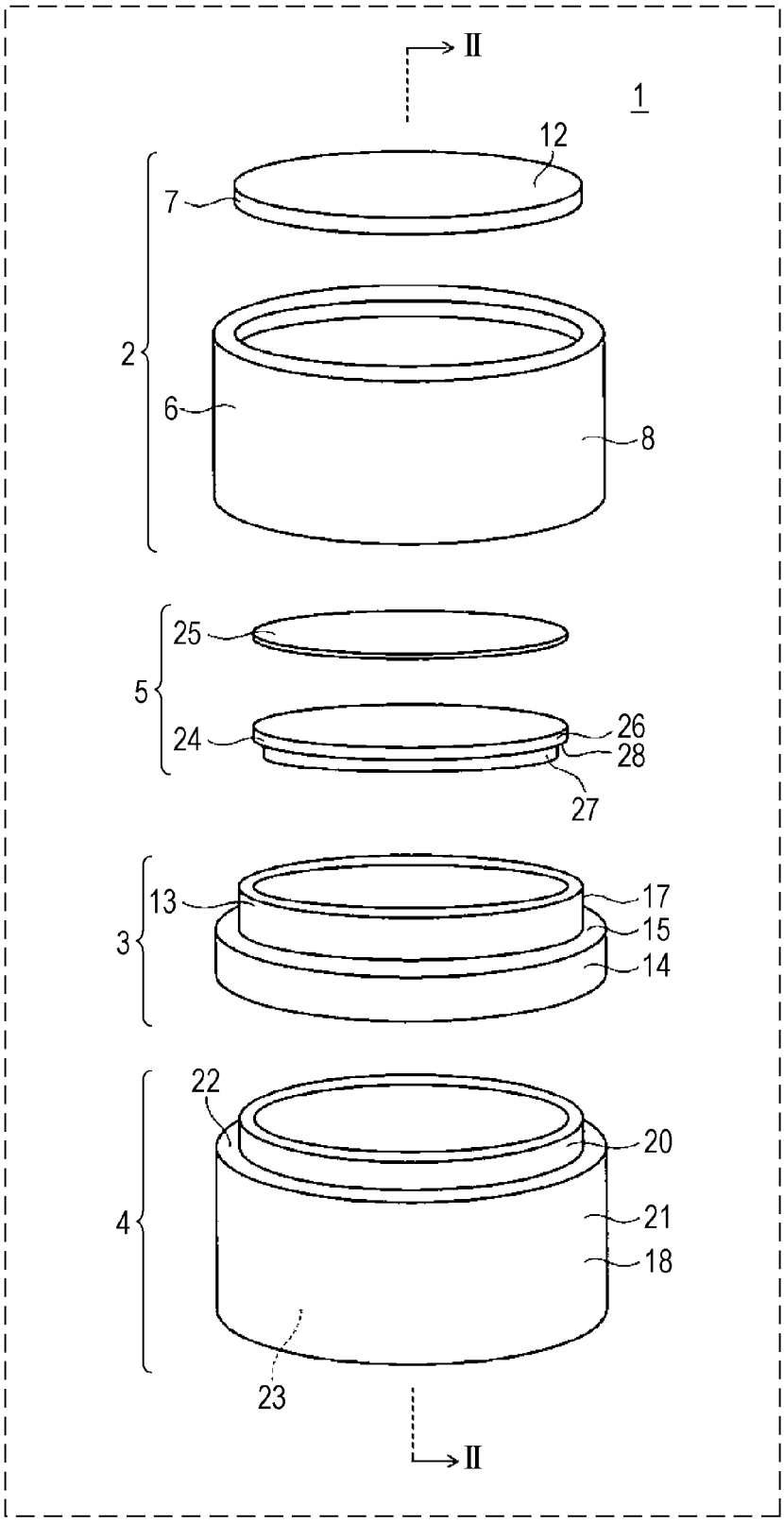
FIG. 1 is an exploded perspective view of a thin film affixing device according to a first embodiment of the present disclosure.
Figure 2:
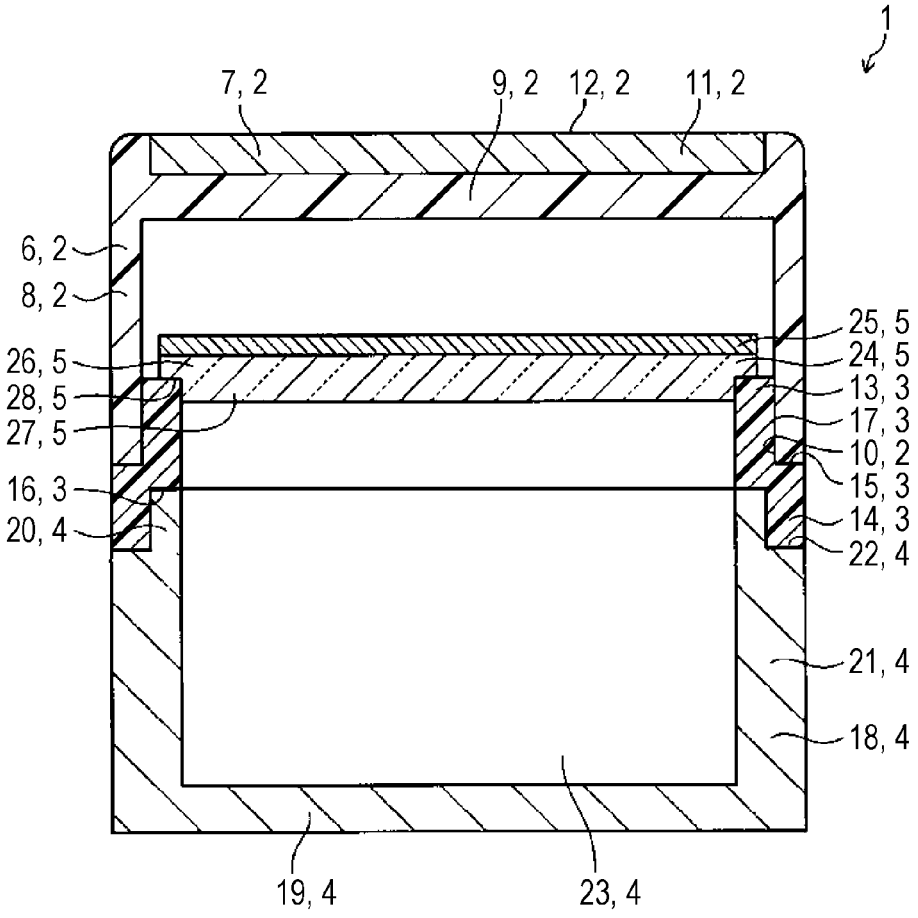
FIG. 2 is a cross-sectional view of an assembled thin film affixing device taken along a line II-II of FIG. 1 according to the first embodiment.

FIG. 1 is an exploded perspective view of the thin film affixing device according to the present embodiment. FIG. 2 is a cross-sectional view taken along a line II-II of FIG. 1.

1.1.1 Overall Configuration of Thin Film Affixing Device

As illustrated in FIG. 1, the thin film affixing device 1 according to the present embodiment includes a cap 2, a holding member 3, a storage case 4, and a device main body 5. The thin film affixing device 1 is a thin film affixing device used to affix a thin film, such as a cosmetic sheet, to the skin.

The device main body 5 functions as a pressing portion for pressing the thin film against the skin when the thin film is affixed to the skin. When using the thin film affixing device 1 (hereinafter simply referred to as "during use"), that is, when a thin film is affixed to the skin (typically the user's own skin), the thin film can be temporarily affixed to the device main body 1 in advance.

The holding member 3 has a function of holding the device main body 5. A user can grip the holding member 3 during use.

The cap 2 has a function of covering the device main body 5 to protect the device main body 5. The cap 2 is removable from the holding member 3. Thus, the cap 2 covers the device main body 5 when the thin film affixing device 1 is not used (hereinafter simply referred to as "during non-use"). In addition, the cap 2 allows the device main body 5 to be exposed during use.

The storage case 4 functions as a container that can store and retain a spare thin film. The storage case 4 is attached to the holding member 3 during non-use. The user can remove the storage case 4 from the holding member 3 and takes out the thin film from the inside and affix the thin film onto the skin by using the thin film affixing device 1.

1.1.2 Structure of Each Unit of Thin Film Affixing Device

The structure of each of the cap 2, the holding member 3, the storage case 4, and the device main body 5 is described below with reference to FIGS. 1 and 2. Note that the exploded perspective view of FIG. 1 is obtained by disassembling the thin film affixing device 1 along the pressing direction in which the thin film is to be pressed against the skin during use. Hereinafter, for convenience of description, the arrangement and shapes of the individual parts are described by using the pressing direction as a reference. In addition, according to the present embodiment, the device main body 5 is disk-shaped, and its axial direction coincides with the pressing direction. In the following description, the terms "pressing direction" and "axial direction" are used interchangeably as appropriate. In terms of the "axial direction", "first side" is the side adjacent to the adherend surface during use and is the upper side in FIGS. 1 and 2. In contrast, the "second side" in terms of the "axial direction" is the side remote from the adherend surface during use and is the lower side in FIGS. 1 and 2.

The cap 2 includes a cap main body 6 and a mirror 7.

The cap main body 6 is made of, for example, a synthetic resin. The cap main body 6 has a tubular cylindrical portion 8 and a disk-shaped bottom portion 9. The bottom portion 9 is provided at a first end in the axial direction of the cylindrical portion 8 (the upper end in FIGS. 1 and 2) and radially inward of the cylindrical portion 8.

The cylindrical portion 8 has a female thread portion 10 on the inner peripheral surface of the second end portion in the axial direction (the lower end portion in FIGS. 1 and 2). In addition, the cylindrical portion 8 has a cylindrical mirror setting space 11 formed by the inner peripheral surface of the first end portion in the axial direction of the cylindrical portion 8 and a first surface in the axial direction of the bottom portion 9. That is, the mirror setting space 11 is a space with a first side in the axial direction open to the air.

The mirror 7 has a disk shape with an outer diameter which allows it to be retained in the mirror setting space 11. The mirror 7 has a mirror surface 12 formed on the first surface in the axial direction. The mirror 7 is disposed in the mirror setting space 11 so that the second surface thereof in the axial direction is in contact with the first surface in the axial direction of the bottom portion 9 of the cap main body 6, and the outer peripheral surface thereof is fitted (e.g., interference-fitted) into the inner peripheral surface of the first end portion in the axial direction of the cylindrical portion 8 of the cap main body 6. The second surface in the axial direction of the mirror 7 is bonded and fixed to the first surface in the axial direction of the bottom portion 9 of the cap main body 6 by using an adhesive agent.

The holding member 3 is made of, for example, a synthetic resin. The holding member 3 includes a tubular first cylindrical portion 13 provided in the first half portion in the axial direction and a tubular second cylindrical portion 14 provided in the second half portion in the axial direction. The outer diameter of the first cylindrical portion 13 is smaller than the outer diameter of the second cylindrical portion 14. The outer peripheral surface of the first cylindrical portion 13 continuously extends to the outer peripheral surface of the second cylindrical portion 14 via a ring-shaped outer stepped portion 15 facing the first side in the axial direction. In contrast, the inner diameter of the first cylindrical portion 13 is smaller than the inner diameter of the second cylindrical portion 14, and the inner peripheral surface of the first cylindrical portion 13 continuously extends to the inner peripheral surface of the second cylindrical portion 14 via the ring-shaped inner stepped portion 16 facing the second side in the axial direction. In addition, the first cylindrical portion 13 has a male thread portion 17 on the outer peripheral surface thereof.

The holding member 3 has the above-described structure, and the cap 2 is attached to the holding member 3 by threadably engaging the male thread portion 17 of the first cylindrical portion 13 with the female thread portion 10 of the cap main body 6. At this time, a second end surface in the axial direction of the cylindrical portion 8 constituting the cap main body 6 is in contact with the outer stepped portion 15 of the holding member 3. According to the present embodiment, the outer peripheral surface of the holding member 3 corresponds to a grip portion, which is a portion the user grips during use. Note that another structure may be employed. That is, instead of providing the female thread portion 10 and the male thread portion 17, the outer peripheral surface of the first cylindrical portion 13 of the holding member 3 may be merely interference-fitted into the inner peripheral surface of the second end portion in the axial direction of the cylindrical portion 8 of the cap main body 6.

The storage case 4 includes a tubular storage cylinder portion 18 and a disk-shaped bottom portion 19. The bottom portion 19 is provided to seal an opening portion formed at the second end in the axial direction of the storage cylinder portion 18.

The inner peripheral surface of the storage cylinder portion 18 has a cylindrical surface shape with an inner diameter that does not change along the entire length in the axial direction. In contrast, the outer peripheral surface of the storage cylinder portion 18 is composed of a small-diameter cylindrical surface 20 provided at the first end portion in the axial direction and a large-diameter cylindrical surface 21 provided at a portion other than the small-diameter cylindrical surface 20. The outer diameter of the large-diameter cylindrical surface 21 is larger than the outer diameter of the small-diameter cylindrical surface 20. In addition, the large-diameter cylindrical surface 21 continuously extends to the small-diameter cylindrical surface 20 via a ring-shaped stepped portion 22 facing the first side in the axial direction.

Figure 3A:
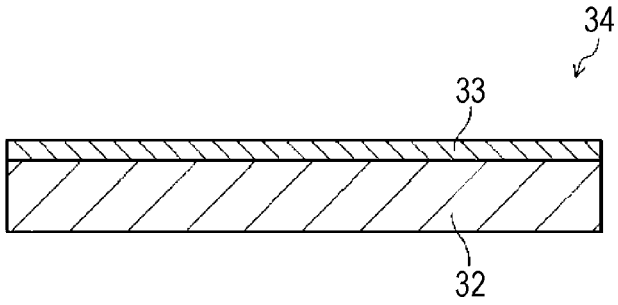
FIGS. 3A to 3C are schematic cross-sectional views illustrating a method for manufacturing a thin film structure used by the thin film affixing device according to the first embodiment.
Figure 3B:
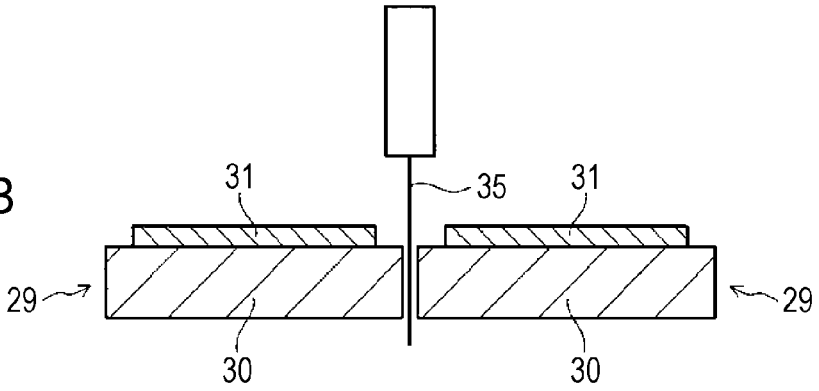
Figure 3C:
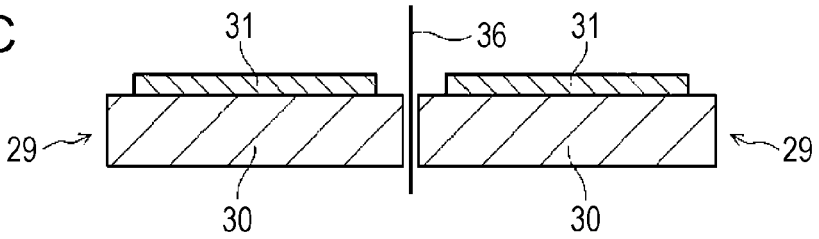

A cylindrical space formed by the inner peripheral surface of the storage cylinder portion 18 and the first surface in the axial direction of the bottom portion 19 serves as, for example, a storage space 23 capable of storing a thin film structure 29 (refer to FIGS. 3A to 3C). Note that the storage space 23 does not necessarily store the thin film structure 29. For example, the storage space 23 may store a small tool used together with the thin film affixing device 1 according to the present embodiment. Furthermore, a lid member (not illustrated) separate from the storage cylinder portion 18 may be provided as necessary. The lid member seals the opening portion at the first side in the axial direction of the storage cylinder portion 18 to prevent, for example, deterioration of the thin film structure 29 stored in the storage space 23. The storage case 4 having the above-described structure is attached to the holding member 3 with the small-diameter cylindrical surface 20 of the storage cylinder portion 18 fitted into the inner peripheral surface of the second cylindrical portion 14 of the holding member 3.

The device main body 5 includes a main portion 24 and a hydrophilic sheet 25 which is a hydrophilic member.

The main portion 24 is a disk-shaped member made of transparent acrylic. The main portion 24 has sufficient rigidity to not significantly deform under the reaction force from the adherend surface when pressed against the adherend surface (a discolored area 42 according to the present embodiment). More specifically, the main portion 24 is a stepped disk member including a disk-shaped large-diameter disk portion 26 provided in the first half portion in the axial direction (the upper half portion in FIGS. 1 and 2) and a disk-shaped small-diameter disk portion 27 provided in the second half portion in the axial direction (the lower half portion in FIGS. 1 and 2). Note that the material of the device main body 5 is not limited to acrylic. For example, the device main body 5 may be made of synthetic resin or glass having transparency. Note that the adherend surface is not limited to the discolored area 42. For example, each of a wrinkle area representing the wrinkles formed on the face of a user and a scar area representing a scar formed on the face of a user corresponds to the adherend surface.

The outer diameter of the large-diameter disk portion 26 is larger than the outer diameter of the small-diameter disk portion 27, and the central axis of the large-diameter disk portion 26 and the central axis of the small-diameter disk portion 27 are positioned so as to be coaxial. The outer peripheral surface of the large-diameter disk portion 26 continuously extends to the outer peripheral surface of the small-diameter disk portion 27 via the disk-shaped stepped portion 28 facing the second side in the axial direction. In addition, each of the first surface in the axial direction of the large-diameter disk portion 26 and the second surface in the axial direction of the small-diameter disk portion 27 is flat. However, the first surface in the axial direction of the large-diameter disk portion 26 and the second surface in the axial direction of the small-diameter disk portion 27 are not necessarily flat surfaces. For example, each of the surfaces may have a spherical shape (for example, a concave spherical shape or a convex spherical shape) with a small curvature.

The hydrophilic sheet (hydrophilic layer) 25 is formed by a hydrophilic film member, such as a film having hydrophilic and transparent properties, or a hydrophilic sheet member, such as a rubber sheet having hydrophilic and transparent properties. More specifically, when the hydrophilic sheet 25 is a film, a film made of polyethylene (PE), polyethylene terephthalate (PET), or the like can be adopted. In contrast, when the hydrophilic sheet 25 is a rubber sheet, a silicone (Si) rubber sheet having a hydrophilic agent applied thereto, an elastomer rubber sheet having a hydrophilic agent applied thereto, an aqueous gel rubber sheet, or a gel pack rubber sheet may be adopted. Alternatively, any one of a variety of materials having hydrophilic and transparent properties can be adopted as the material of the hydrophilic sheet.

The hydrophilic sheet 25 is a sheet member having a circular shape as viewed in the axial direction. The outer diameter of the hydrophilic sheet 25 is the same as or substantially the same as the outer diameter of the large-diameter disk portion 26 constituting the main portion 24. The hydrophilic sheet 25 having the above-described structure is bonded and fixed to the first surface in the axial direction of the large-diameter disk portion 26 (that is, the first surface of the main portion 24) by using, for example, a transparent adhesive agent. The thin film 31 can be provisionally affixed (that is, temporarily affixed) to the first surface in the axial direction of the hydrophilic sheet 25 with the hydrophilic sheet 25 bonded and fixed to the large-diameter disk portion 26. That is, the hydrophilic sheet 25 functions as a temporary adherend portion of the thin film 31. Note that the hydrophilic member is not limited to a sheet member such as the hydrophilic sheet 25 according to the present embodiment.

The device main body 5 described above is transparent from the first surface in the axial direction of the hydrophilic sheet 25 to the second surface in the axial direction of the main portion 24. That is, according to the apparatus main body 5 of the present embodiment, a user located on the second side in the axial direction of the device main body 5 can get a view of the first side in the axial direction of the device main body 5 through the device main body 5. Note that the transparency possessed by the device main body 5 is not limited to being perfectly transparent and wholly colorless as long as the user can get the above-described view.

The device main body 5 having the above-described structure is assembled to the holding member 3 such that the stepped portion 28 is in contact with the first end surface in the axial direction of the holding member 3, and the outer peripheral surface of the small-diameter disk portion 27 is fitted into and is in contact with the inner peripheral surface of the first end portion in the axial direction of the holding member 3. Accordingly, the large-diameter disk portion 26 of the main portion 24 protrudes to the first side in the axial direction from the first end surface in the axial direction of the holding member 3. In this manner, the holding member 3 holds the main portion 24 so that the temporary adherend portion provided on the first surface in the axial direction of the main portion 24 can press against the adherend surface (e.g., the discolored area 42). In addition, the holding member 3 having the device main body 5 assembled thereto is formed in a cylindrical shape that opens on both sides in the axial direction. Thus, the holding member 3 does not cover the first surface and the second surface of the main portion 24 of the device main body 5. Consequently, the holding member 3 holds the device main body 5 including the main portion 24 so that a user located on the second side of the apparatus main body 5 can get a view of the first side of the device main body 5 through the main portion 24 of the apparatus main body 5.

1.2 Thin Film Structure

An example of the configuration of the thin film structure 29 used in the thin film affixing device 1 according to the present disclosure and a method for manufacturing the thin film structure 29 is briefly described with reference to FIGS. 3A to 3C.

The thin film structure 29 includes a support body 30 and a thin film (for example, a nanosheet) 31 which does not cause any discomfort even when the thin film 31 is affixed to the human skin. In addition, the thin film structure 29 is biocompatible.

The support body 30 is a sheet member having a predetermined shape. The support body 30 is made of, for example, paper or nonwoven fabric having water absorbability and hydrophilicity, a porous film, or a nanofiber sheet. In addition, the support body 30 may include a second support body (not illustrated) that differs from the support body 30. For example, the second support body is made of plastic or the like. The second support body is provided in tight contact with the surface of the support body 30 opposite to the surface on which the thin film 31 is placed. The area of the surface of the second support body on the side that is in tight contact with the support body 30 may be the same as the area of the surface of the support body 30. However, it is desirable that the area of the surface of the second support body be larger than the area of the surface of the support body 30. In addition, an auxiliary mark image may be formed on the second support body. By providing the second support body in this manner, the strength of the thin film structure 29 can be increased and, thus, the user can easily use the thin film structure 29.

The thin film 31 is a sheet member having water permeability. The material of the thin film 31 is not limited to a particular one, and any thin film can be used. For example, as the material of the thin film, one of the following materials can be used: polyesters typically involving polyglycolic acid, polylactic acid, polycaprolactone, polyethylene succinate, polyethylene terephthalate, and a copolymer thereof, polyethers typically involving polyethylene glycol and polypropylene glycol, polyamides typically involving nylon, polyglutamic acid, polyaspartic acid, and salts thereof, polysaccharides typically involving pullulan, cellulose, starch, chitin, chitosan, alginic acid, hyaluronic acid, corn starch, and salts thereof, silicones typically involving acrylic silicone and trimethylsiloxysilicate, acrylic acids typically involving alkyl acrylate, silicone acrylate, amide acrylate, and copolymers thereof, and polyvinyl alcohol, polyurethane, polycarbonate, polyanhydride, polyethylene, and polypropylene. The thickness of the thin film 31 can be in the range of 10 to 10000 nm (10 nm to 10 μm) and is preferably in the range of 10 to 1000 nm. When the thin film has a hydrophobic property, the thickness is particularly preferably in the range of 10 to 800 nm. Such a thin film 31 is affixed to a first surface (the upper surface in FIGS. 3A to 3C) of the support body 30 such that the outer peripheral edge of the thin film 31 is located at a position slightly away from the outer peripheral edge of the support body 30 toward the center of the thin film 31 (for example, 30 μm).

A technique for manufacturing the thin film structure 29 is briefly described below. Note that among techniques for manufacturing the thin film structure 29 other than the technique for cutting the thin film structure 29 are the same as techniques for manufacturing the thin film structures described in Japanese Unexamined Patent Application Publication Nos. 2015-193604 and 2014-140978. Accordingly, detailed description of the techniques is not repeated.

First, a pre-cutting structure 34 in which a pre-cutting thin film 33 is affixed to the first surface of a pre-cutting support body 32 illustrated in FIG. 3A is produced by using a technique described in, for example, Japanese Unexamined Patent Application Publication No. 2015-193604 or 2014-140978.

Subsequently, by emitting a laser 35 to the pre-cutting structure 34, the pre-cutting structure 34 is cut into the thin film structures 29 each having a predetermined size illustrated in FIG. 3B. At this time, because the material constituting the thin film 31 is more heat-sensitive than the material constituting the support body 30, the heat of the laser 35 causes the cutting surface of the thin film 31 to melt and shrink in a direction away from the laser 35 (that is, toward the center of the thin film 31) more than the cut surface of the support body 30. As a result, the outer peripheral edge of the thin film 31 is located at a position slightly closer to the center of the thin film 31 than the outer peripheral edge of the support body 30. Note that, even when, as illustrated in FIG. 3C, a configuration in which the pre-cutting structure 34 is cut by the heated cutter 36 instead of the laser 35 is employed, the thin film structure 29 having the same features can be produced. By using this cutting technique, when a user peels off the support body 30 from the thin film structure 29, the user can hung a finger on only the support body 30, so that the support body 30 can be easily peeled off from the thin film structure 29.

In FIGS. 3A to 3C, the pre-cutting support body 32 is also cut. However, by adjusting the laser output, only the pre-cutting thin film 33 can be cut without cutting the pre-cutting support body 32. A thin film structure obtained by cutting in this manner has a structure in which a plurality of thin films 31 are attached to the first surface of the pre-cutting support body 32. In the case of such a structure, by pressing the temporary adherend portion against the thin film 31 such that the cut line of the thin film 31 overlaps the outer peripheral edge of the temporary adherend portion of the device main body 5, only the thin film having a necessary shape can be peeled off (picked up) from the pre-cutting support body 32 along the cut line.

1.3 How to Use Thin Film Affixing Device

An example of a method for affixing a thin film by using the thin film affixing device 1 according to the present embodiment is described below with reference to FIGS. 4A to 4I and FIG. 6. More specifically, a method is described in which a user 40 uses the thin film affixing device 1 according to the present embodiment to affix the thin film 31 on the discolored area 42, such as a patch in a cheek 41 of the user 40. Note that the discolored area 42 corresponds to a portion indicated by a diagonal lattice in FIG. 4G and FIG. 6.

1.3.1 First Step

Figures 4A, 4B, 4C, 4D, 4E, 4F, 4G, 4H, 4I:
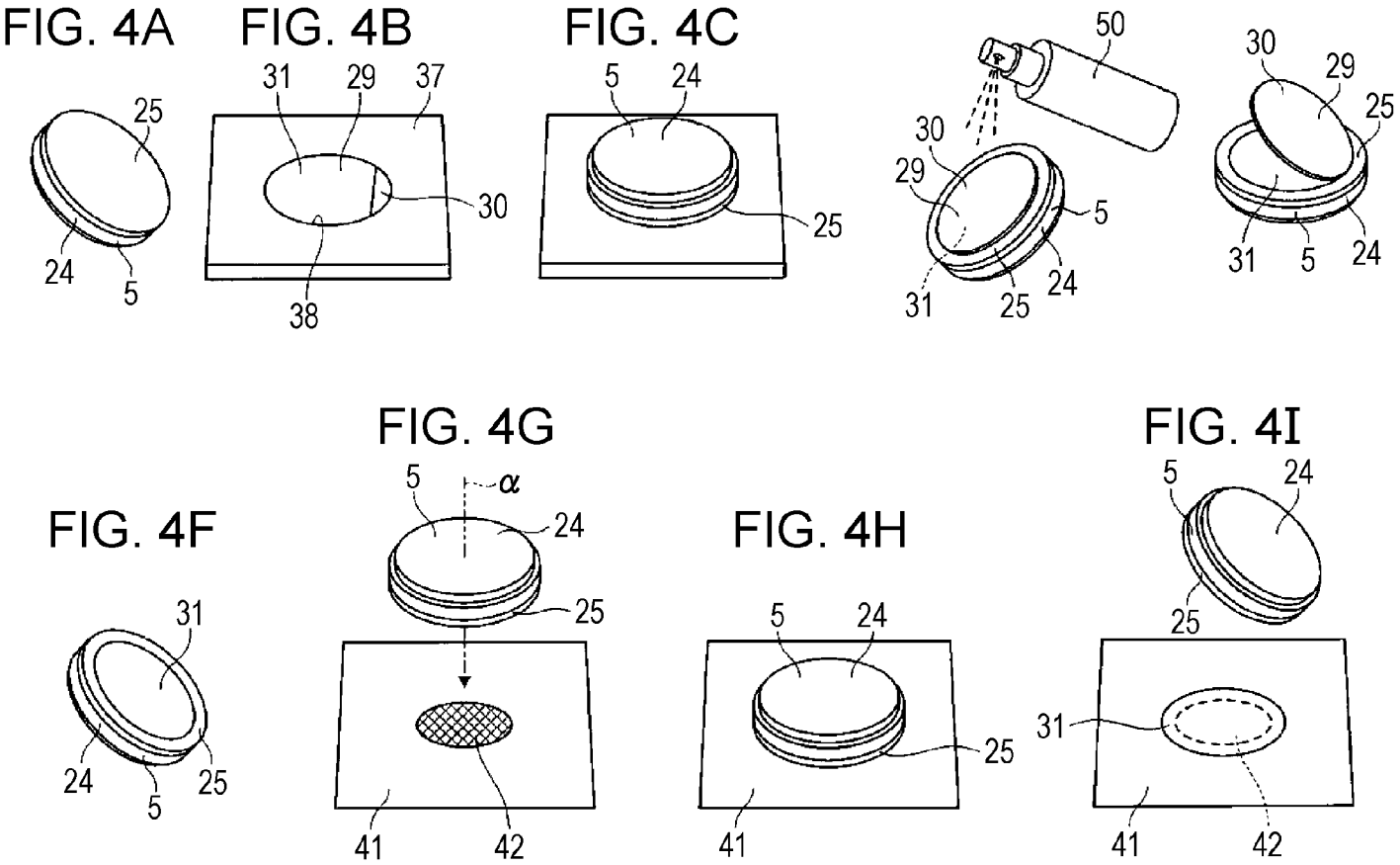
FIGS. 4A to 4I are schematic illustrations of a step by step example of how to use the thin film affixing device according to the first embodiment.

The cap 2 and the storage case 4 are removed from the thin film affixing device 1 first. At this time, the thin film affixing device 1 is viewed as illustrated in FIG. 4A. Note that in FIGS. 4A to 4I, the holding member 3 is not illustrated. Subsequently, a necessary number of the thin film structures 29 stored in the storage space 23 of the storage case 4 are taken out. At this time, the taken-out thin film structure 29 is held in a holder 37 that is separately provided (refer to FIG. 4B). More specifically, the thin film structure 29 is held so that the thin film 31 is placed to face upward in a holding recessed portion 38 formed on the side surface of the holder 37. In FIG. 4B, part of the thin film 31 is not illustrated. Alternatively, the thin film structure 29 may be held by hand without using the holder 37.

1.3.2 Second Step

Subsequently, the user 40 grips the outer peripheral surface of the holding member 3 with one hand and temporarily affixes the first surface (the upper surface in FIG. 4B) of the thin film 31 which constitutes the thin film structure 29 to the temporary adherend portion which is constituted by the first surface in the axial direction of the hydrophilic sheet 25 which constitutes the device main body 5. More specifically, as illustrated in FIG. 4C, the first surface in the axial direction of the hydrophilic sheet 25 which constitutes the device main body 5 is pressed against the first surface of the thin film 31 of the thin film structure 29 held by the holder 37. According to this example, no adhesive layer or the like is provided on the first surface in the axial direction of the hydrophilic sheet 25 to which the thin film 31 is to be affixed. Note that in the first step, if the thin film 31 is held by hand, the first surface of the thin film 31 of the thin film structure 29 is affixed onto the first surface in the axial direction of the hydrophilic sheet 25 which constitutes the device main body 5 by hand. In any case, in the second step, as illustrated in FIG. 4D, the thin film structure 29 is affixed to the first surface in the axial direction of the hydrophilic sheet 25 which constitutes the device main body 5 via the thin film 31.

1.3.3 Third Step

Figure 5A:
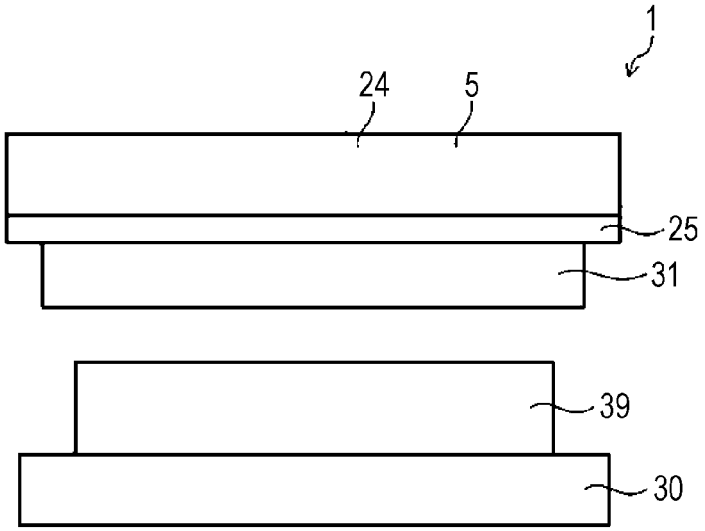
FIG. 5A is a schematic illustration of a thin film of the thin film structure when being peeled off from a support body.

Subsequently, as illustrated in FIG. 4E, the support body 30 is peeled off from the thin film structure 29 (the thin film 31) affixed to the first surface in the axial direction of the hydrophilic sheet 25. Thus, the view illustrated in FIG. 4F is obtained. At this time, if moisture is supplied to the support body 30 by, for example, a mist spray 50, a water layer 39 is formed between the support body 30 and the thin film 31 as illustrated in FIG. 5A. Consequently, the support body 30 can be easily peeled off from the thin film 31.

1.3.4 Fourth Step

Subsequently, as illustrated in FIG. 4G, the device main body 5 is set so as to be parallel or substantially parallel to the discolored area 42 formed on the cheek 41 of the user 40. In other words, the device main body 5 is set so that the center axis of the device main body 5 is perpendicular or substantially perpendicular to the discolored area 42.

1.3.5 Fifth Step

Figure 6:
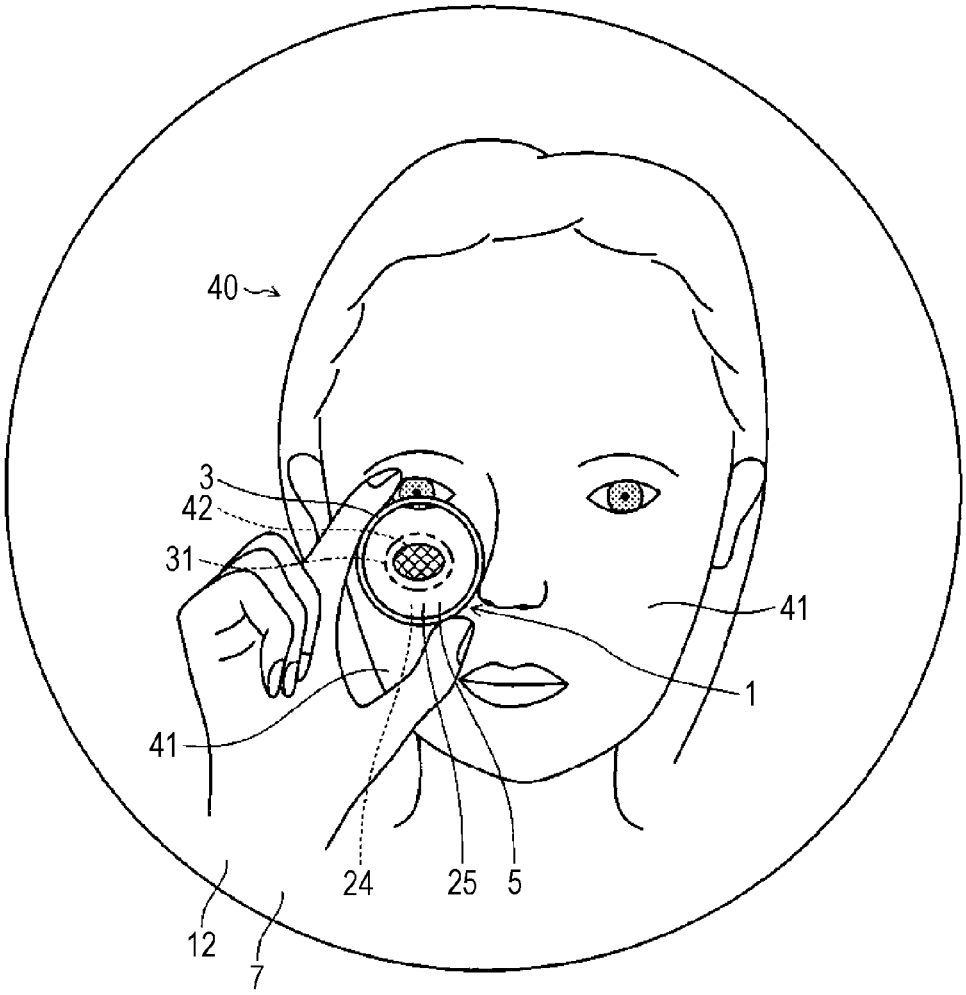
FIG. 6 is a schematic illustration of a user reflected in a mirror when the user affixes a thin film to a discolored area by using the thin film affixing device.

Subsequently, in the view given in FIG. 4G, the position of the device main body 5 in a direction parallel to the discolored area 42 is adjusted so that the discolored area 42 overlaps the thin film 31 affixed to the hydrophilic sheet 25 as viewed in the axial direction of the device main body 5. According to the present embodiment, as illustrated in FIG. 6, by viewing the face of the user 40 reflected in the mirror 7 of the cap 2, the user 40 can check the positional relationship between the discolored area 42 and the thin film 31 affixed to the hydrophilic sheet 25 and perform the position adjustment. That is, according to the present embodiment, as indicated by a two-dot chain line arrow a in FIG. 4G, the user 40 can view the discolored area 42 from the second side of the device main body 5 in the axial direction (the upper side in FIG. 4G and the front side of FIG. 6) through the device main body 5. Consequently, if, at this time, the user 40 views themselves reflected in the mirror 7, the user 40 can correctly align the positions of the discolored area 42 and the thin film 31 affixed to the hydrophilic sheet 25, as illustrated in FIG. 6.

1.3.6 Sixth Step

Subsequently, as illustrated in FIG. 4H, the thin film 31 affixed to the first surface in the axial direction of the hydrophilic sheet 25 which constitutes the device main body 5 is pressed against the discolored area 42.

1.3.7 Seventh Step

Figure 5B:
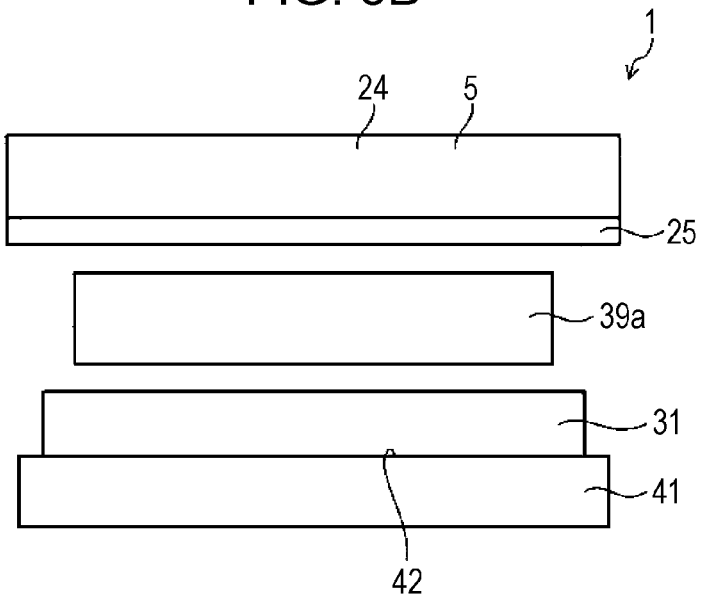
FIG. 5B is a schematic illustration of a thin film of the thin film structure when being peeled off from a hydrophilic sheet.

Finally, as illustrated in FIG. 4I, the device main body 5 is separated from the cheek 41. At this time, the thin film 31 is affixed to the discolored area 42. Note that in the case where the device main body 5 is separated from the cheek 41, if the discolored area 42 contains moisture, the moisture in the discolored area 42 permeates through the thin film 31 and, thus, a water layer 39*a* is formed between the thin film 31 and the hydrophilic sheet 25, as illustrated in FIG. 5B. For this reason, the thin film 31 is easily peeled off from the hydrophilic sheet 25. In the case where the discolored area 42 does not contain moisture, it is desirable to supply moisture to the thin film 31 affixed to the discolored area 42 or the first surface in the axial direction of the hydrophilic sheet 25 by using, for example, the mist spray 50 (refer to FIG. 4D) as needed.

1.4 Operation and Effect of Thin Film Affixing Device

According to the thin film affixing device 1 having the above-described structure according to the present embodiment, the thin film 31 can be accurately affixed to the discolored area 42 which is the adherend surface. That is, according to the present embodiment, as described above, the user 40 can press the thin film 31 against the discolored area 42 with the positions of the discolored area 42 and the thin film 31 affixed to the hydrophilic sheet 25 exactly aligned. As a result, the thin film 31 can be affixed to the discolored area 42 with high accuracy.

In addition, according to the present embodiment, by using the cutting technique illustrated in FIGS. 3A to 3C, a finger is hooked to only the support body 30 when the support body 30 is peeled off from the thin film structure 29. As a result, the support body 30 can be easily peeled off from the thin film structure 29.

In addition, according to the present embodiment, a hydrophilic sheet 25 having hydrophilicity and a thin film 31 having hydrophobicity and water permeability are adopted. As a result, as described with reference to FIG. 5B, when the thin film 31 is affixed to the discolored area 42, the thin film 31 is easily peeled off from the hydrophilic sheet 25 by merely supplying moisture to the discolored area 42 or the thin film 31.

Furthermore, according to the present embodiment, the storage case 4 for storing the thin film 31 is provided. As a result, the portability of the thin film affixing device 1 and the thin film structure 29 can be improved. In addition, according to the present embodiment, the cap 2 is provided to cover the first surface in the axial direction of the hydrophilic sheet 25. As a result, the probability of a foreign material depositing onto the temporary adherend portion formed on the first surface in the axial direction of the hydrophilic sheet 25 is reduced and, thus, the hydrophilic sheet 25 can be protected. Furthermore, according to the present embodiment, the mirror 7 is provided on the cap 2. As a result, the affixing operation can be carried out even in a place where no mirror is installed.

1.5 Supplementary Statement

According to the first embodiment, the device main body 5 includes the main portion 24 and the hydrophilic sheet 25 provided as a member separate from the main portion 24. However, for example, the hydrophilic sheet 25 may be removed, and a coating agent having hydrophilicity may be coated on the first surface in the axial direction of the main portion 24. Alternatively, a hydrophilic surface layer may be provided on the first surface in the axial direction of the main portion 24 by reformulation of the surface (for example, UV light irradiation).

2. Second Embodiment

Figure 7:
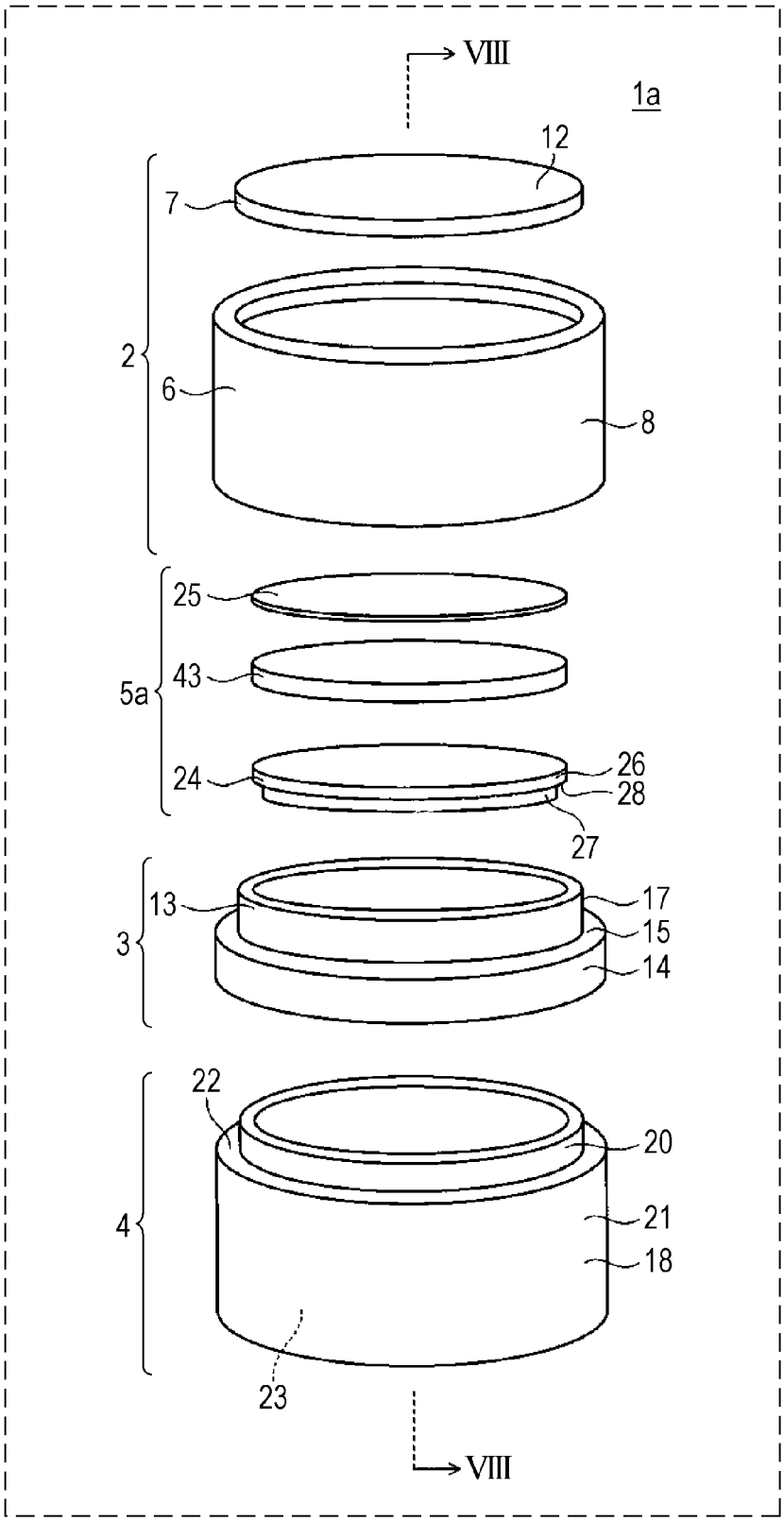
FIG. 7 is an exploded perspective view of a device main body that constitutes a thin film affixing device according to a second embodiment of the present disclosure.
Figure 8:
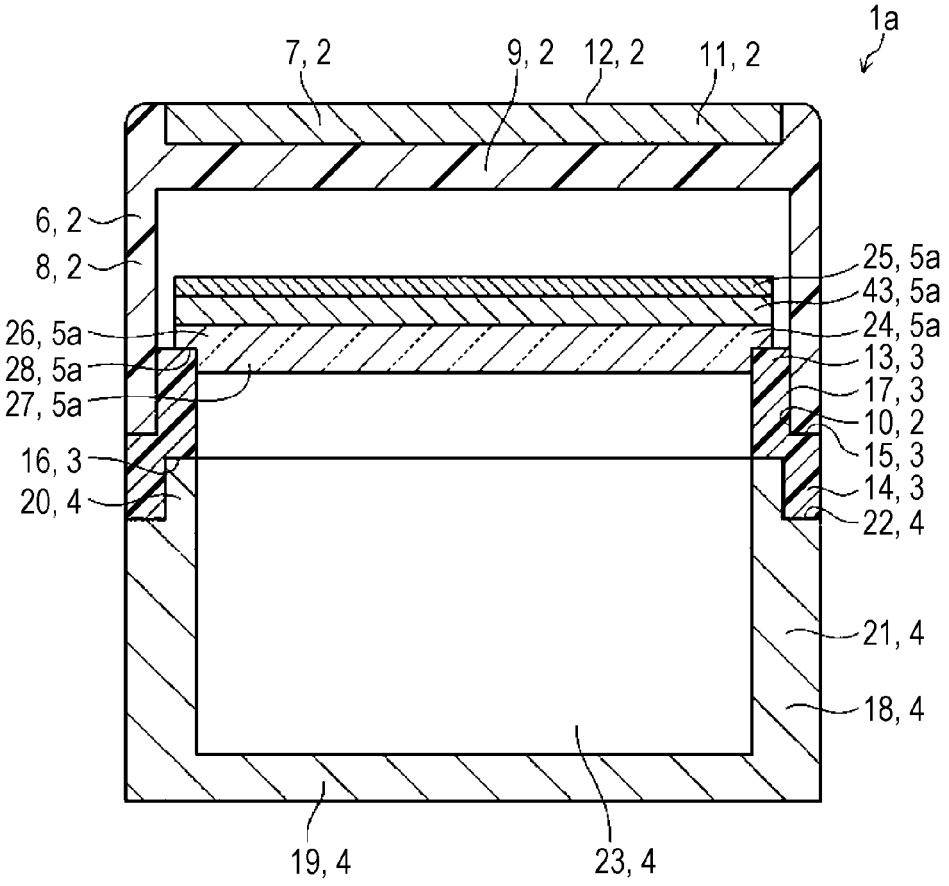
FIG. 8 is a cross-sectional view of an assembled thin film affixing device taken along a line VIII-VIII of FIG. 7 according to the second embodiment.

A second embodiment according to the present disclosure is described below with reference to FIGS. 7 and 8.

2.1 Thin Film Affixing Device

In a thin film affixing device 1*a* according to the second embodiment, the structure of a device main body 5*a* differs from that of the above-described first embodiment. Hereinafter, description is mainly given with reference to differences in structure between the thin film affixing device 1*a* according to the second embodiment and the thin film affixing device 1 according to the first embodiment. In addition, when the structure the same as that of the thin film affixing device 1 according to the first embodiment is described, the drawings used in the description of the first embodiment are referred to as needed.

The device main body 5*a* constituting the thin film affixing device 1*a* according to the present embodiment includes a main portion 24, an elastic sheet 43 which is an elastic member, and a hydrophilic sheet 25.

Among the above constituent elements, the structures of the main portion 24 and the hydrophilic sheet 25 are the same as those of the first embodiment.

The elastic sheet 43 is transparent. The elastic sheet 43 is made of, for example, an elastomer, such as rubber, or an elastic material, such as silicon (Si). Thus, the elastic sheet 43 is made of a material which is softer than the material constituting the main portion 24 (for example, acrylic) and which has elasticity. Such an elastic sheet 43 has a circular sheet shape (a disk shape) as viewed in the axial direction (the up-down direction in FIGS. 7 and 8). The outer diameter of the elastic sheet 43 is the same or substantially the same as that of a large-diameter disk portion 26 which constitutes the main portion 24 and that of the hydrophilic sheet 25. The first and second surfaces in the axial direction of the elastic sheet 43 have a flat surface shape. However, the first surface in the axial direction of the elastic sheet 43 may have a spherical shape (for example, a concave spherical surface, a convex spherical surface) having a small curvature, instead of a flat surface shape. The elastic sheet 43 having the above-described structure is sandwiched by the first surface in the axial direction of the main portion 24 (the upper surface in FIGS. 7 and 8) and the second surface in the axial direction of the hydrophilic sheet 25 (the lower surface in FIGS. 7 and 8) via a transparent adhesive agent or the like.

Even in the present embodiment having the above-described structures, the device main body 5*a* has transparency from the first surface in the axial direction of the hydrophilic sheet 25 to the second surface in the axial direction of the main portion 24. Consequently, the device main body 5*a* allows a user to get a view of the first side in the axial direction of the device main body 5*a* from the second side in the axial direction of the device main body 5*a* through the device main body 5*a*.

2.2 Operation and Effect of Thin Film Affixing Device

According to the present embodiment having the above-described structures, the elastic sheet 43 made of a material (having elasticity) that is softer than the main portion 24 is provided between the main portion 24 and the hydrophilic sheet 25. Consequently, when the thin film 31 affixed to the first surface in the axial direction of the hydrophilic sheet 25 is pressed against the discolored area 42 formed on the cheek 41 of the user 40 (refer to FIG. 6), the thin film 31 can be gently touched against the cheek 41. The other structures and the operation and effect are the same as those in the first embodiment.

2.3 Supplementary Statement on Second Embodiment

According to the above-described second embodiment, the device main body 5*a* is configured by the main portion 24, the elastic sheet 43, and the hydrophilic sheet 25. However, if the elastic sheet 43 having at least a hydrophilic first surface in the axial direction is used, the need for the hydrophilic sheet 25 can be eliminated. When such a structure is employed, the elastic sheet is made of an elastic material having hydrophilicity, for example. In this case, the elastic sheet corresponds to a hydrophilic member. Alternatively, the elastic sheet may be made of an elastic material having no hydrophilicity, and a coating agent having hydrophilicity may be coated on the first surface in the axial direction of the elastic sheet, or a hydrophilic surface layer may be provided on the first surface in the axial direction of the elastic sheet by reformulation of the surface (for example, UV light irradiation or ozone treatment).

3. Third Embodiment

Figure 9A:
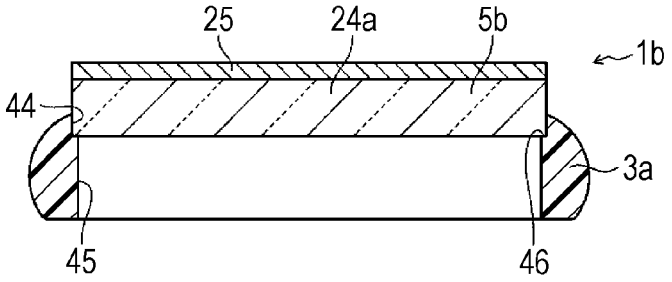
FIG. 9A is a cross-sectional view of an assembled thin film affixing device taken along the line II-II of FIG. 1 according to a third embodiment of the present disclosure.
Figure 9B:
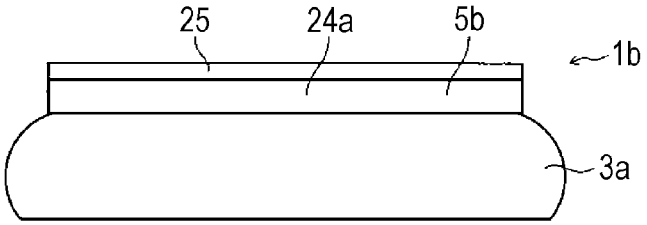
FIG. 9B is a side view of the assembled thin film affixing device according to the third embodiment.

A third embodiment according to the present disclosure is described below with reference to FIGS. 9A and 9B.

3.1 Thin Film Affixing Device

A thin film affixing device 1*b* according to the third embodiment has a structure obtained by removing a cap 2 and a storage case 4 from the structure of the thin film affixing device 1 according to the above-described first embodiment. More specifically, the thin film affixing device 1*b* according to the present embodiment includes a holding member 3*a* and a device main body 5*b*.

For example, the holding member 3*a* is a cylindrical member made of a synthetic resin. The cross-sectional shape (in other words, the shape of the generating line) of the outer peripheral surface of the holding member 3*a* in an imaginary plane including the center axis (each of the planes of FIGS. 9A and 9B) is curved. More specifically, according to the present embodiment, the shape of the generating line of the outer peripheral surface of the holding member 3*a* is a composite curve having non-constant curvature. However, the shape of the generating line of the outer peripheral surface of the holding member 3*a* may be a curve having a constant curvature. The inner peripheral surface of the holding member 3*a* is formed by a large-diameter cylindrical surface 44 provided in the first end portion in the axial direction (the upper end portion illustrated in FIG. 9A) and a small-diameter cylindrical surface 45 provided in a portion other than the large-diameter cylindrical surface 44. The inner diameter of the large-diameter cylindrical surface 44 is larger than the inner diameter of the small-diameter cylindrical surface 45, and the large-diameter cylindrical surface 44 continuously extends to the small-diameter cylindrical surface 45 via a ring-shaped stepped portion 46 facing the first side in the axial direction.

The device main body 5*b* is composed of a main portion 24*a* and a hydrophilic sheet 25.

The main portion 24*a* is a transparent disk-shaped member made of acrylic. The outer peripheral surface of the main portion 24*a* is cylindrical in shape with an outer diameter that does not change along the entire length in the axial direction. The outer peripheral surface of the main portion 24*a* can be fitted into the large-diameter cylindrical surface 44 of the holding member 3*a*.

The structure of the hydrophilic sheet 25 is the same as that of the above-described first embodiment.

The device main body 5*b* having the above-described structure is assembled to the holding member 3*a* such that the radially outer end portion of the second end surface in the axial direction of the main portion 24*a* is in contact with the stepped portion 46 of the holding member 3*a*, and the other peripheral surface of the second end portion in the axial direction of the main portion 24*a* is fitted into the large-diameter cylindrical surface 44 of the holding member 3*a*. At this time, the first end surface in the axial direction of the main portion 24*a* protrudes to the first side in the axial direction beyond the first end edge in the axial direction of the holding member 3*a*. The other structures and the operation and effect are the same as those of the first embodiment.

3.2 Supplementary Statement on Third Embodiment

When the structure according to the present embodiment is implemented, one of the device main bodies 5 and 5*a* according to the above-described first and second embodiments, respectively, can be adopted instead of the above-described device main body 5*b*.

4. Fourth Embodiment

Figure 10:
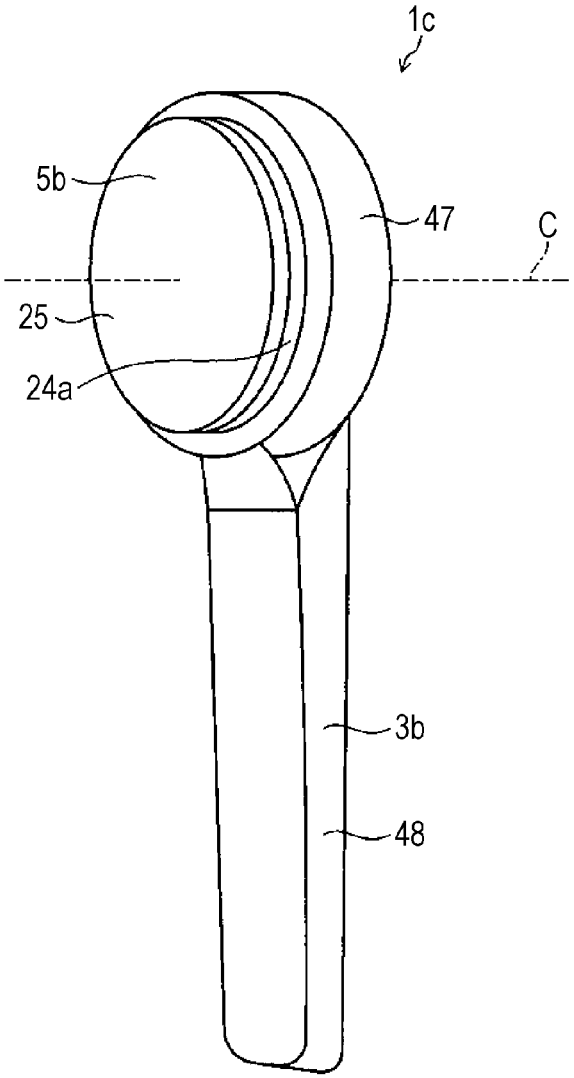
FIG. 10 is a perspective view of a thin film affixing device according to a fourth embodiment of the present disclosure.

A fourth embodiment according to the present disclosure is described below with reference to FIG. 10.

4.1 Thin Film Affixing Device

In a thin film affixing device 1*c* according to the fourth embodiment, the structure of a holding member 3*b* differs from that of the thin film affixing device 1*b* according to the third embodiment. The structure of a portion of the thin film affixing device 1*c* that differs from that of the thin film affixing device 1*b* according to the third embodiment is described below.

The holding member 3*b* constituting the thin film affixing device 1*c* according to the present embodiment includes a fixed portion 47 and a grip member 48.

The structure of the fixed portion 47 is substantially the same as the structure of the holding member 3*a* (refer to FIGS. 9A and 9B) constituting the thin film affixing device 1*b* according to the third embodiment described above.

The grip member 48 is provided so as to extend outward in the radial direction of the fixed portion 47 from the position of one point in the circumferential direction of the outer peripheral surface of the fixed portion 47. The grip member 48 having such a structure is a rod-shaped member having a substantially rectangular or substantially elliptical cross-sectional shape in an imaginary plane perpendicular to the length direction (the up-down direction in FIG. 10). According to the present embodiment, the extending direction (the length direction) of the grip member 48 coincides with the radial direction of the fixed portion 47. That is, the grip member 48 extends in a direction parallel to an imaginary plane perpendicular to a central axis C of the fixed portion 47.

4.2 Operation and Effect of Thin Film Affixing Device

According to the present embodiment having the above-described structures, the thin film affixing device 1*c* includes the grip member 48. Consequently, the hand of the user 40 can be placed at a position away from the face during the affixing operation. As a result, interference between the hand and face of the user 40 does not normally occur. In addition, since the hand of the user 40 does not easily enter the field of view of the user 40, the operability can be improved.

4.3 Supplementary Statement on Fourth Embodiment

When the structures according to the present embodiment are implemented, one of the device main bodies 5 and 5*a* according to the above-described first and second embodiments, respectively, can be adopted instead of the device main body 5*b*.

5. Fifth Embodiment

Figure 11:
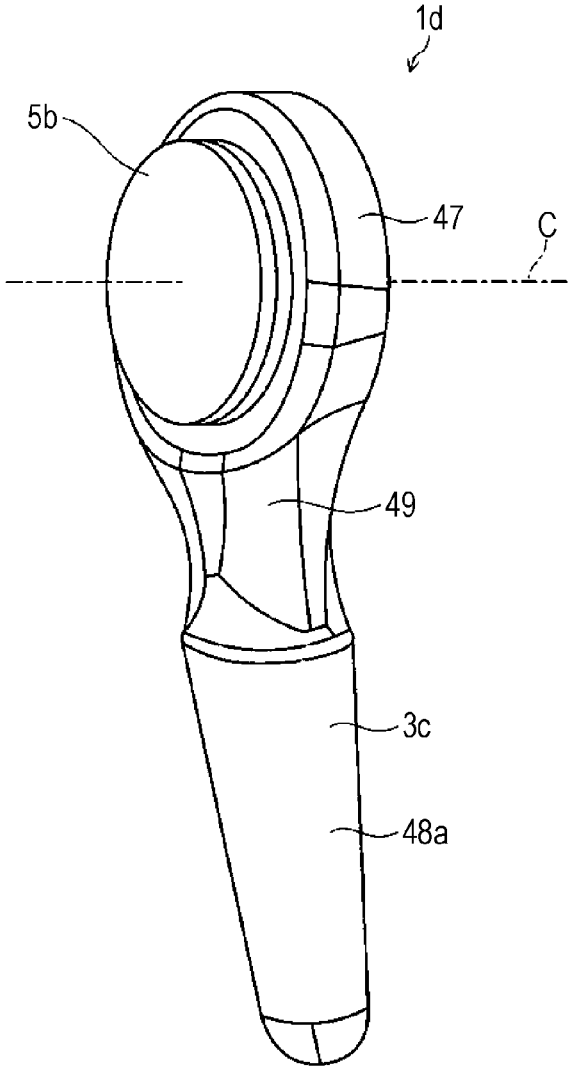
FIG. 11 is a perspective view of a thin film affixing device according to a fifth embodiment of the present disclosure.

A fifth embodiment according to the present disclosure is described below with reference to FIG. 11.

5.1 Thin Film Affixing Device

In a thin film affixing device 1*d* according to the fifth embodiment, the structure of a grip member 48*a* that constitutes a holding member 3*c* differs from that of the above-described thin film affixing device 1*c* (refer to FIG. 10) according to the fourth embodiment. The structure of the portions of the thin film affixing device 1*d* that differs from that of the thin film affixing device 1*c* according to the fourth embodiment is described below.

The holding member 3*c* constituting the thin film affixing device 1*d* according to the present embodiment includes a fixed portion 47 and a grip member 48*a*.

The structure of the fixed portion 47 is the same as the structure of the holding member 3*b* (refer to FIG. 10) constituting the above-described thin film affixing device 1*c* according to the fourth embodiment.

The grip member 48*a* is a rod-shaped member provided so as to extend outward in the radial direction of the fixed portion 47 from the position of one point in the circumferential direction of the outer peripheral surface of the fixed portion 47. The grip member 48*a* having such a structure has, for example, a substantially rectangular or substantially elliptical cross-sectional shape in an imaginary plane perpendicular to the extending direction. The grip member 48*a* has a constricted portion 49 that is narrower than the other portion at one end in the extending direction (the end adjacent to the fixed portion 47). In addition, according to the present embodiment, the grip member 48*a* is inclined from an imaginary plane perpendicular to the central axis C of the fixed portion 47 to the second side in the axial direction more toward the other side in the extending direction.

5.2 Operation and Effect of Thin Film Affixing Device

According to the present embodiment having the above-described structures, the grip member 48*a* of the thin film affixing device 1*d* is provided so as to be inclined with respect to the fixed portion 47 in the above-described manner. As a result, the occurrence of interference between the hand and the face of the user 40 holding the grip member 48*a* can be reduced, as compared with the structure of the fourth embodiment described above.

5.3 Supplementary Statement on Fifth Embodiment

When the structure according to the present embodiment is implemented, one of the device main bodies 5 and 5*a* according to the above-described first and second embodiments, respectively, can be adopted instead of the device main body 5*b*.

In each of the above-described embodiments according to the present disclosure, the main portion of the device main body that constitutes the thin film affixing device is formed from a single disk-shaped acrylic plate. However, the main portion can be formed from, for example, two acrylic plates provided so as to be separated from each other in the axial direction and be parallel to each other. When adopting such a structure, the first surface in the axial direction of one of the two acrylic plates serves as the front surface, and the second surface in the axial direction of the other acrylic plate serves as the back surface. Note that even when such a structure is adopted, the main portion has sufficient rigidity to not significantly distort (deform) under the reaction force from the adherend surface when pressed against the adherend surface (the discolored area 42 according to the present embodiment).

In each of the first to fifth embodiments described above, the main portion constituting the device main body is formed as a disk-shaped member having a circular shape as viewed in the axial direction. However, the main portion is not limited to such a structure. For example, the main portion may be formed as a member having a shape of, for example, a diamond, a star, or a heart as viewed in the axial direction. When such a structure is adopted, the shapes of the holding member and the hydrophilic layer are determined so as to appropriately correspond to the shape of the main portion.

While the above first embodiment has been described with reference to the adherend surface being the discolored area 42 of the cheek 41, the thin film affixing device according to the present disclosure can be used to affix a thin film to an adherend surface other than a human face. In addition, the thin film affixing device according to the present disclosure can be used for affixing a thin film to part of the body of an object other than a person (for example, an animal). Furthermore, the thin film affixing device according to the present disclosure can be used not only for beauty but also for affixing a medical thin film to a wound (for example, a film for closing a wound).

6. Sixth Embodiment

A sixth embodiment according to the present disclosure is described below with reference to FIGS. 12A, 12B, and 13.

6.1 Thin Film Affixing Device

A thin film affixing device 1*e* according to the sixth embodiment includes only a holding member and a temporary adherend portion (a hydrophilic sheet) of the thin film affixing device 1 according to the first embodiment described above. In addition, the material and the shape of a holding member 3 differ from those according to the first embodiment. The structure of the thin film affixing device 1*e* according to the present embodiment is mainly described below. Thereafter, a storage case 4*e* that stores the thin film affixing device 1*e* according to the sixth embodiment and a thin film is described.

The thin film affixing device 1*e* according to the present embodiment is configured by a holding member 3*e* and a hydrophilic sheet 25 bonded to a surface of the holding member 3*e* by using, for example, an adhesive agent. The holding member 3*e* is made of a material having transparency, a flat plate shape, and elasticity (e.g., soft transparent resin or gel). The holding member 3*e* is adjustably mountable so as to follow the individual difference in the shape of the cheek 41 of the user 40 within the elastic deformation range of the holding member 3*e*. At this time, the hydrophilic sheet 25 bonded to the surface of the holding member 3*e* is also elastically deformed. The material of the hydrophilic sheet 25 is the same as that of the first embodiment. In addition, like the first embodiment, the thin film 31 can be temporarily affixed to a surface of the hydrophilic sheet 25 (the surface opposite to the surface having the holding member 3*e* bonded thereto). The thickness of the holding member 3*e* depends on the elasticity of the material. In this example, the thickness is in the range of 0.1 to 15 mm, which enables the holding member 3*e* to easily cope with the individual difference in the shape of the cheek 41 of the user 40, and is more preferably in the range of about 6 to 8 mm.

6.2 Storage Case

Figure 12A:
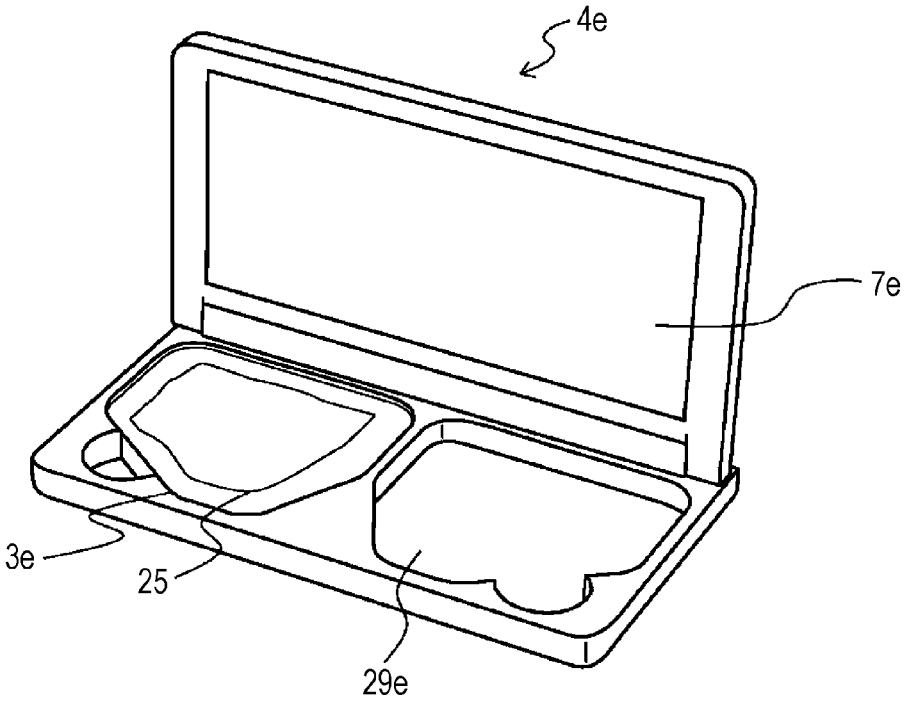
FIG. 12A illustrates a thin film structure and a thin film affixing device that are stored according to the fifth embodiment of the present disclosure.

As illustrated in FIG. 12A, the storage case 4*e* stores a thin film structure 29*e* corresponding to the thin film structure described in the first embodiment and the thin film affixing device 1*e* according to the present embodiment side by side. Since the thin film affixing device 1*e* according to the present embodiment is planar, the thin film affixing device 1*e* can be stored in a small storage case. Thus, the user can easily carry the thin film affixing device 1*e*. A mirror may be formed on the inner surface of the storage case and be used by the user to see if the thin film has been appropriately affixed to the skin.

Figure 12B:
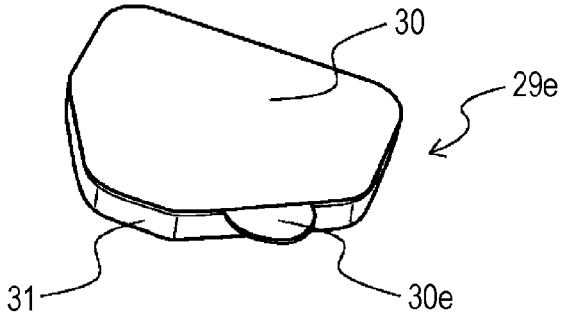
FIG. 12B illustrates the thin film structure according to the fifth embodiment of the present disclosure.

According to the present embodiment, as illustrated in FIG. 12B, the thin-film structure 29*e* has a structure made by providing a peeling tab 30*e* (that is, an extended portion beyond the outline of the thin film 31) to the support body 30 of the thin film structure 29 so that the user easily pinches the tab and peels off the support body 30. Like the first embodiment, the discolored area 42 (not illustrated) corresponding to a discolored area of the user, such as a patch of the skin, is printed on the thin film 31. Note that the adherend surface is not limited to the discolored area 42. For example, one of a variety of areas, such as a wrinkle area representing the wrinkles formed on the face of a user and a scar area representing a scar formed on the face of a user, corresponds to the adherend surface.

6.3 how to Use Thin Film Affixing Device

Figure 13:
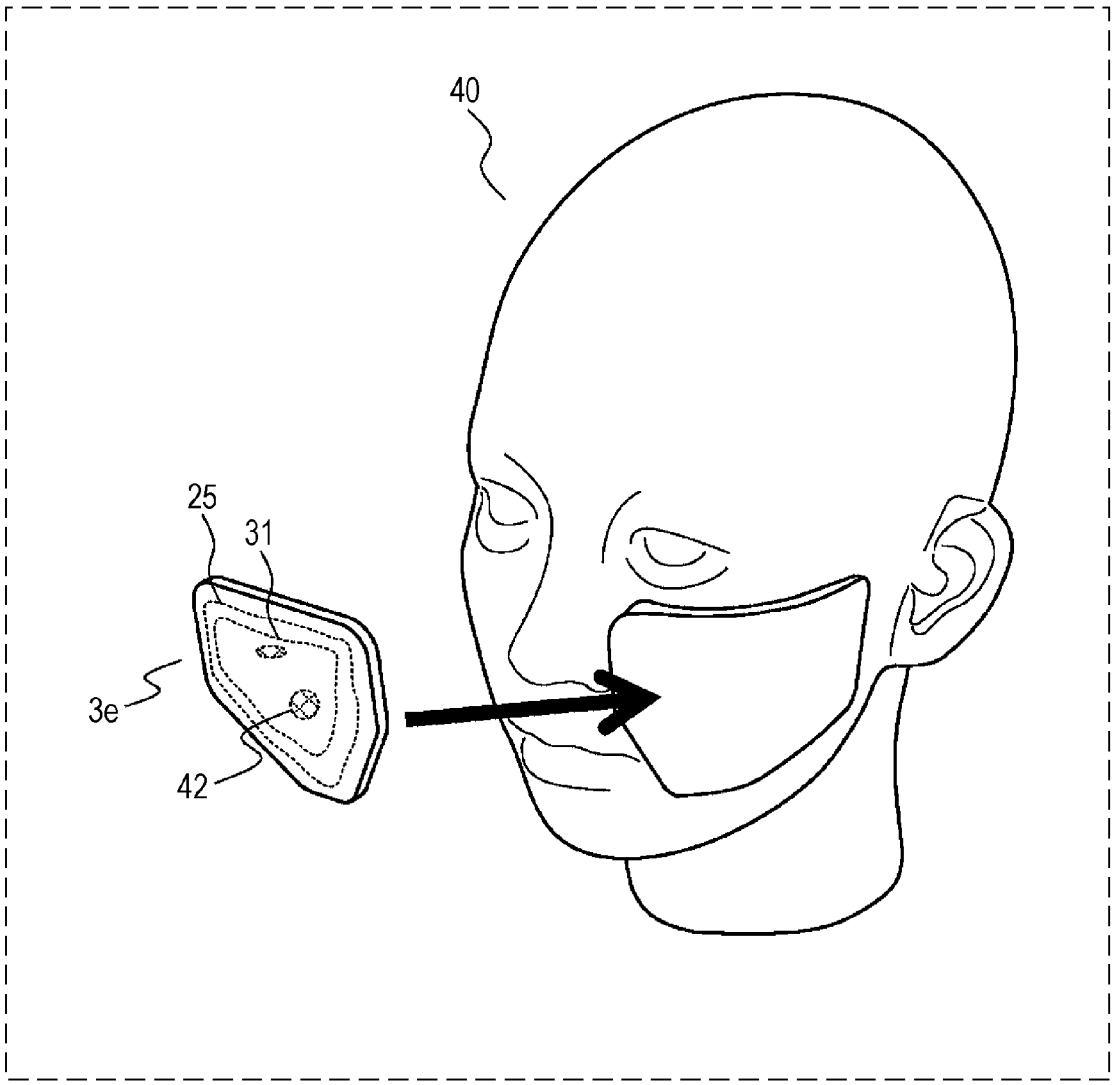
FIG. 13 illustrates an example of how to use the thin film affixing device according to the fifth embodiment of the present disclosure.

FIG. 13 illustrates an example of a method for affixing the thin film 31 to the discolored area (not illustrated), such as a patch of the skin of the user 40, by using the thin film affixing device 1*e* according to the present embodiment. The steps are substantially the same as second to seventh steps described in the first embodiment and, thus, detailed description of the steps is not repeated. The thin film 31 of the thin film structure 29*e* taken out from the storage case 4*e* has, printed thereon, the discolored area 42 corresponding to the discolored area, such as a patch of the skin of the user. Note that the discolored area 42 corresponds to a portion indicated by a diagonal lattice in FIG. 13. The surface of the thin film 31 (the surface remote from the support body) is temporarily affixed to the surface of the hydrophilic sheet 25 of the thin film affixing device 1*e*, and moisture is supplied to a surface of the thin film 31 by using, for example, a mist spray. Thereafter, the peeling tab 30*e* of the support body is pinched and is peeled off. Subsequently, as illustrated in FIG. 13, the thin film is pressed against the discolored area 42 (not illustrated) of the cheek of the user 40. Note that unlike the first embodiment, the thin film affixing device 1*e* according to the present embodiment has a flat holding member. However, the whole flat holding member is made of a transparent material. Consequently, when the thin film 31 is pressed against the discolored area of the cheek of the user 40, the user can press the thin film 31 while checking the position of the discolored area 42 of the thin film 31. In addition, at this time, the mirror 7*e* in the storage case 4*e* may be used.

6.4 Operation and Effect of Thin Film Affixing Device

According to the present embodiment having the above-described structures, the thin film affixing device 1*e* includes the holding member 3*e* having elasticity, such as gel, and a hydrophilic sheet 25. By using such a structure, the thin film affixing device 1*e* can easily cope with a portion with a large area and a large curvature and the individual difference of the user. As a result, the thin film affixing device 1*e* can reliably affix the thin film to the face or a variety of parts of the body.

In particular, the thin film affixing device according to the present disclosure is useful for cosmetic applications.

What is claimed is:

1. A thin film affixing device for affixing a thin film to an adherend surface, comprising:

a transparent main portion having a first surface and a second surface, the first surface having a temporary adherend portion that allows the thin film to be temporarily attached thereto;

a holding member that holds the main portion so that a first side of the main portion is viewable from a second side of the main portion, through the main portion, in an axial direction and the temporary adherend portion is capable of pressing against the adherend surface; and a transparent hydrophilic layer formed on the first surface of the main portion so as to serve as the temporary adherend portion.

2. The thin film affixing device according to claim 1, wherein the thin film is temporarily attached to the temporary adherend portion before the thin film is affixed to the adherend surface.

3. The thin film affixing device according to claim 1, wherein the hydrophilic layer is a hydrophilic member provided on the first surface of the main portion, and wherein an elastic member having transparency is disposed between the main portion and the hydrophilic member.

4. The thin film affixing device according to claim 1, wherein the holding member includes the grip member that is grippable.

5. The thin film affixing device according to claim 1, further comprising:

a cap provided on the first side of the main portion so as to be removable from the holding member, the cap protecting the hydrophilic layer; and a storage portion provided on the second side of the main portion so as to be removable from the holding member, the storage portion storing the thin film that is unused.

6. The thin film affixing device according to claim 5, wherein the cap includes a mirror.

7. A thin film affixing device for affixing a thin film to an adherend surface of skin, comprising:

a transparent hydrophilic sheet; and a holding member that adheres to the hydrophilic sheet via an adhesive surface of the hydrophilic sheet, wherein the holding member is made of a material having transparency, a flat plate shape, and elasticity; and the hydrophilic sheet has a surface on which the thin film is temporarily attached to, and the surface is opposite to the adhesive surface.

8. The thin film affixing device according to claim 7, wherein the thickness of the holding member is from 0.1 mm to 15 mm.

9. The thin film affixing device according to claim 7, wherein a discolored area, corresponding to a discolored area of a user, such as a patch of the skin, is printed on the thin film.

10. The thin film affixing device according to claim 7, wherein the holding member is made of soft transparent resin or gel.

11. The thin film affixing device according to claim 7, wherein the thin film is made of polyethylene (PE) or polyethylene terephthalate (PET).

12. The thin film affixing device according to claim 7, wherein a support body is laminated on the thin film and the support body includes a peeling tab.

13. A method for affixing a thin film to an adherend surface of skin, comprising:

attaching the thin film temporarily to a transparent hydrophilic sheet on a surface opposite to an adhesive surface of the transparent hydrophilic sheet that is adhered to a holding member; and pressing the holding member on a discolored area of a cheek of a user so that the thin film affixes to the discolored area, wherein the holding member is made of a material having transparency, a flat plate shape, and elasticity.

14. A storage case, comprising a housing configured to store the thin film and the thin film affixing device according to claim 1, wherein the housing is configured to store the thin film and the thin film affixing device side-by-side.

* * * * *